US005601357A

United States Patent [19]

Rangarajan

[11] Patent Number: 5,601,357

[45] Date of Patent: Feb. 11, 1997

[54] PORTABLE GAS APPLIANCE

[75] Inventor: Anand Rangarajan, Acton, Mass.

[73] Assignee: ThermoLyte Corporation, Waltham, Mass.

[21] Appl. No.: 580,861

[22] Filed: Dec. 29, 1995

[51] Int. Cl.[6] ..... F21L 19/00

[52] U.S. Cl. ..... 362/179; 431/344; 431/255; 431/100; 137/508

[58] Field of Search ..... 431/344, 255, 431/100, 109; 126/403, 404, 406, 407, 409, 412, 414; 362/179; 137/494, 508

[56] References Cited

U.S. PATENT DOCUMENTS

| | | | |
|---|---|---|---|
| 2,002,884 | 5/1935 | Deming . | |
| 2,642,083 | 6/1953 | Strong . | |
| 2,662,348 | 12/1953 | Jacobsson . | |
| 2,793,504 | 5/1957 | Webster . | |
| 2,854,991 | 10/1958 | Webster . | |
| 3,118,494 | 1/1964 | Yost et al. . | |
| 3,183,686 | 5/1965 | Tissot-Dupont . | |
| 3,388,962 | 6/1968 | Baumann et al. . | |
| 3,452,522 | 7/1969 | Tissot Dupont . | |
| 3,583,289 | 6/1971 | Wilson et al. . | |
| 3,699,998 | 10/1972 | Baranowski, Jr. . | |
| 3,711,236 | 1/1973 | Kinsella et al. . | |
| 3,736,093 | 5/1973 | Bowman et al. . | |
| 3,812,877 | 5/1974 | Fleischhacker et al. . | |
| 3,941,554 | 3/1976 | Curtis . | |
| 3,955,913 | 5/1976 | Benzaria . | |
| 4,003,694 | 1/1977 | Lowell . | |
| 4,177,646 | 12/1979 | Guadagnin et al. . | |
| 4,273,150 | 6/1981 | Paduch et al. . | |
| 4,475,882 | 10/1984 | Gruner | 362/179 |
| 4,497,339 | 2/1985 | Gruner et al. . | |
| 4,975,044 | 12/1990 | Diederich | 431/100 |
| 5,018,963 | 5/1991 | Deiderich . | |
| 5,107,885 | 4/1992 | Nakazawa et al. | 137/508 |

*Primary Examiner*—Carroll B. Dority
*Attorney, Agent, or Firm*—Fish & Richardson P.C.

[57] ABSTRACT

A gas powered appliance includes housing structure with a fuel inlet port and recess structure for receiving fuel canister structure in communication with the inlet port. Fuel supply conduit structure in the housing structure has an outlet port. Fuel control structure in the housing structure controls flow of fuel from the inlet port through the fuel supply conduit structure to the outlet port. Fuel canister structure is adapted for disposition in the recess structure. The fuel canister structure has a body portion, outlet valve structure on the body portion for coupling to the inlet port when the fuel canister structure is disposed in the recess structure, and check valve structure disposed in the fuel canister body portion in communication with the outlet valve structure for preventing liquid fuel from reaching the flow control structure.

28 Claims, 3 Drawing Sheets

PORTABLE GAS APPLIANCE

BACKGROUND OF THE INVENTION

This invention relates to portable gas appliances such as flashlights or gas torches.

In such appliances, the fuel is typically a liquid fuel that is supplied to the appliance from a pressurized fuel supply reservoir. A controller desirable controls the flow of fuel from the fuel supply and shuts off the fuel supply when desired. It is also necessary to substantially reduce the pressure of liquified fuel as it passes out of the supply to the appliance to aid in metering of vaporized liquified fuel. In many such appliances, the operating characteristics of the appliance may change widely depending on the operating temperature and the orientation of the fuel supply. If liquid fuel is passed to the appliance without complete vaporization, a markedly increased burn rate may result. A check valve arrangement, for example of the type shown in co-pending U.S. patent application Ser. No. 08/338,000, filed Nov. 10, 1994 now U.S. Pat. No. 5,522,722 and entitled FUEL CONTROL, the disclosure of which is expressly incorporated herein, is of use in reducing these problems. However, operating characteristics of the check valve may drift, due to factors such as impurities in the fuel, and periodic replacement of the check valve may be advisable.

In accordance with one aspect of the invention, there is provided a gas powered appliance that includes housing structure with a fuel inlet port and recess structure for receiving fuel canister structure in communication with the inlet port. Fuel supply conduit structure in the housing structure has an outlet port, and fuel control structure in the housing structure controls flow of fuel from the inlet port through the fuel supply conduit structure to the outlet port. The fuel canister structure is adapted for releasable disposition in the recess structure, and has a body portion, outlet valve structure on the body portion for coupling to the inlet port when the fuel canister structure is disposed in the recess structure, and check valve structure releasably disposed in the recess structure in communication with the outlet valve structure for preventing liquid fuel from reaching the flow control structure when the fuel canister structure is disposed in the recess structure.

In particular embodiments, the check valve structure is in the fuel canister structure, and in other embodiments, the check valve structure is releasably attached to the fuel canister structure. In preferred embodiments, the appliance is a portable light source and has a handle portion sized to be grasped in a hand, and a head portion of larger dimension than the handle portion that includes lens structure. Mantle structure is composed of multifilament metal oxide strands, supported on fuel supply conduit structure adjacent the outlet port and ignitor mechanism is disposed in the housing structure for igniting fuel to cause the mantle structure to become incandescent and emit optical radiation. The fuel canister structure contains a liquid hydrocarbon fuel such as isobutane, propane, gasoline, or the like.

The check valve structure may be of various types such as a flat gasket type, a duck bill type, or a diaphragm type.

Preferably, the check valve structure includes a check valve diaphragm member disposed in the check valve chamber that divides that check valve chamber into upstream and downstream chambers. Check valve structure is carried by the check valve diaphragm and valve seat structure is disposed in the upstream check valve chamber, the check valve structure being adapted to close when the pressure differential between the upstream and downstream check valve chambers is less than a predetermined value such that fuel does not flow from the upstream check valve chamber to the downstream check valve chamber. In particular embodiments the check valve pressure differential that causes the check valve structure to close is in the range of 5–12 pounds per square inch.

In accordance with another aspect, there is provided a fuel canister for use with a portable gas appliance, the gas powered appliance including housing structure with a fuel inlet port and recess structure for receiving fuel canister structure, fuel supply conduit structure in the housing structure that has an outlet port, and fuel control structure in the housing structure for controlling flow of fuel from the inlet port through the fuel supply conduit structure to the outlet port. The fuel canister structure is adapted for releasable disposition in the recess structure and includes outlet passage structure for coupling to inlet port structure of the gas appliance, outlet valve structure disposed in the outlet passage that has a normally closed position preventing flow of fuel from the fuel canister and an open position, and check valve structure in the body of the fuel canister and coupled to the outlet valve structure. The check valve structure is adapted to open when the pressure differential between the upstream check valve chamber and the downstream check valve chamber is greater than an predetermined value so that fuel flows from the upstream check valve chamber to said downstream check valve chamber.

In accordance with another aspect of the invention, there is provided a releasable check valve assembly for releasable coupling to a fuel canister. The check valve assembly has outlet passage structure for coupling to inlet port structure of a gas appliance, inlet passage structure for coupling to the outlet port of the fuel canister, control valve structure disposed in the outlet passage that has a normally closed position preventing flow of fuel to the gas appliance and an open position, check valve structure in the detachable assembly, the check valve structure being disposed between the inlet passage and the control valve structure for preventing liquid fuel from reaching the control valve structure when the fuel canister is coupled to the gas appliance, and releasable coupling structure. The releasable coupling may be of the resilient snap type, the screw type or a bayonet type for example. In a particular embodiment, the check valve structure includes a check valve diaphragm member that defines the check valve chamber into upstream and downstream chambers, and the control valve structure includes a valve member that is biased against a resilient gasket member to close the outlet port.

Other features and advantages of the invention will be seen as the following description of particular embodiments progresses, in conjunction with the drawings, in which:

DESCRIPTION OF PARTICULAR EMBODIMENTS

Figure 1:
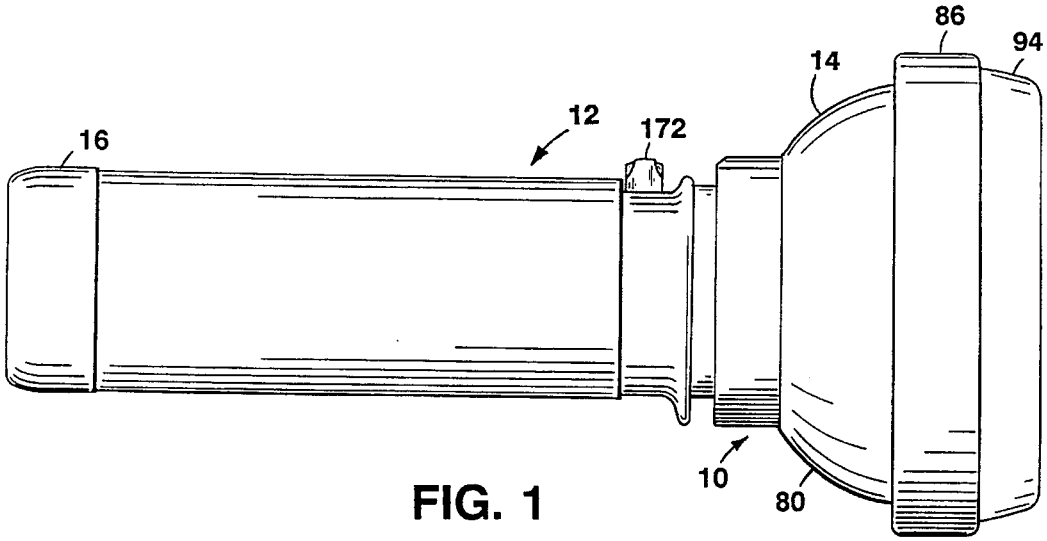
FIG. 1 is a diagrammatic view of a portable flashlight type gas appliance in accordance with the invention.

Shown in FIG. 1 is a flashlight 10 that has housing structure with handle portion 12 and head portion 14. Handle portion 12 has cap 16 at its end which closes chamber 18 that receives fuel canister 20 as indicated in FIG. 2.

Figure 2:
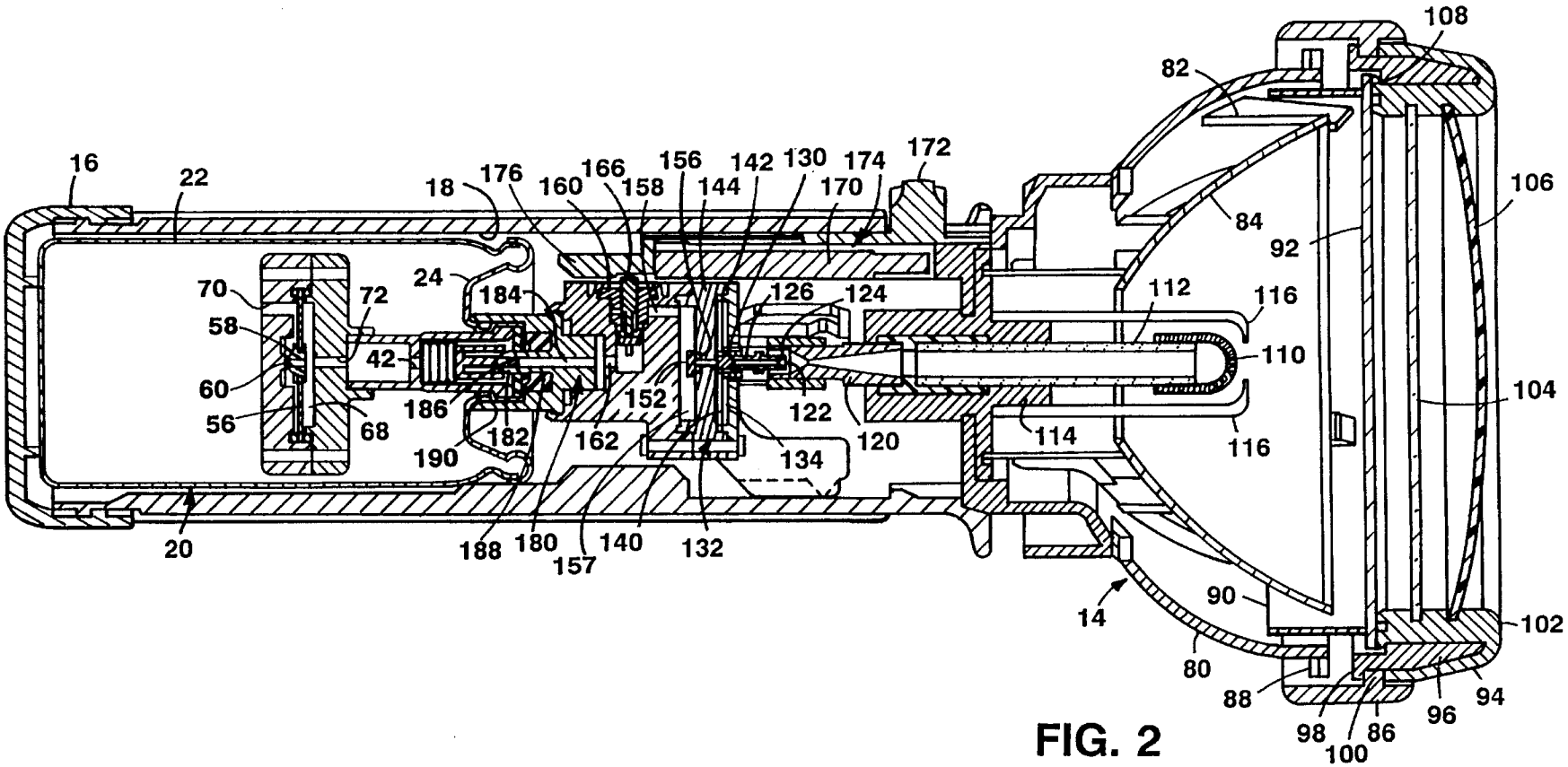
FIG. 2 is a sectional view through a portion of the appliance shown in FIG. 1 showing details of the fuel control system.
Figure 3:
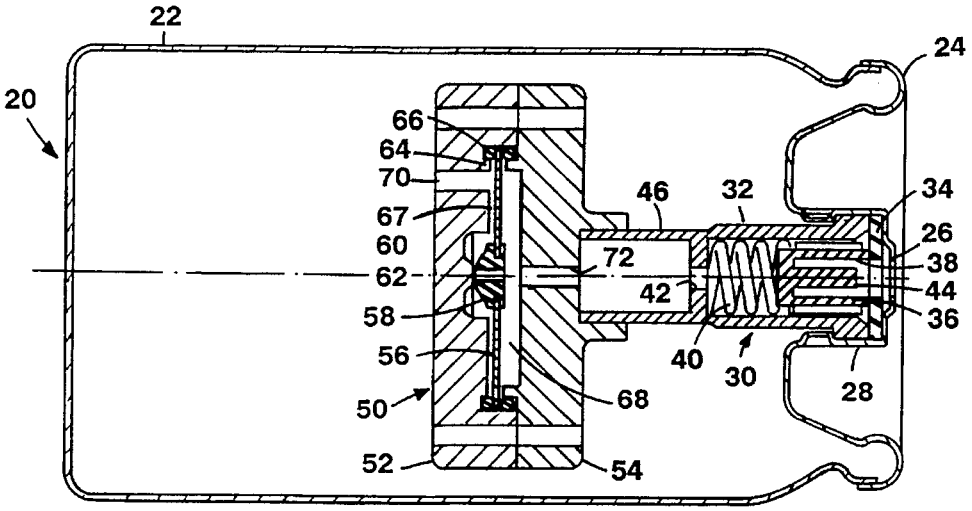
FIG. 3 is a sectional view showing details of the fuel canister shown in FIG. 2.

Further details of the flashlight 10 may be seen with reference to FIGS. 2 and 3. Canister 20 includes tubular shell 22 of drawn aluminum that has a diameter of about three centimeters and a length of about six centimeters. Plated steel cap 24 is secured to shell body 22 and defines outlet port 26 and housing portion 28 in which is disposed outlet valve 30. Valve 30 includes cylindrical housing 32, resilient valve seat 34, and valve member 36 which has valve surface 38 that is urged against valve seat 34 by coil spring 40. The valve 30 has inlet port 42 that has a diameter of about 1.5 millimeters. Valve member 36 includes post 44 which is accessible through port 26 for opening valve 30 when canister 20 is seated in recess chamber 18 and secured by cap 16. Valve housing 32 has extension sleeve 46 on which is mounted check valve assembly 50 that includes housing members 52, 54 between which is secured stainless steel diaphragm 56 that carries check valve member 58 that has through passage 60 surrounded by valve seat surface 62. Diaphragm 56 is a stainless steel disk that is about 0.1 millimeter thick and has a diameter of about 1.6 centimeters and is seated between housing members 52, 54 with its peripheral portion disposed between circumferential ridges 64 and sealed by O-rings 66. Upstream check valve chamber 67 has a depth of about 0.1 millimeter, downstream check valve chamber 68 has a depth of about 0.2 millimeter and each chamber 67, 68 has a diameter of about one centimeter. Inlet passage 70 is formed in housing member 52 and outlet passage 72 is formed in member 54.

Should liquid propane pass through check valve passage 60 into downstream check valve chamber 68, the pressure in chamber 68 immediately rises and slams check valve 58 closed. Valve 58 remains closed until the liquid fuel in check valve chamber 68 is vaporized and then reopens automatically to allow continued fuel flow through the check valve to outlet valve 30.

With reference to FIG. 2, the head portion 14 includes flared shell portion 80 with latch projections 82 that seat and secure hemispherical reflector 84 on head portion 14. Flared shell 80 also includes ring portion 86 that is secured to shell 80 by a series of webs 88. Ring 86 receives flame arrester ring 90 and glass lens 92 which is secured in place by ring assembly 94 that has an inner ring member 96 with flange projection 98 that is retained by latch projections 100 on ring portion 86. The outer ring portion 102 carries a second glass lens 104 and a plastic lens member 106, and has projections 108 that seat on the periphery of lens 92 for securing that lens member in place.

Disposed within reflector 84 is metal oxide (itriaceria) fiber mantle 110 that is supported on alumina support tube 112 that is received in support member 114. Further aspects of mantle 110 and its support tube 112 may be seen with reference to Diederich U.S. Pat. No. 4,975,044, the disclosure of which is expressly incorporated herein by reference. Also mounted on support 114 are piezoelectric electrodes 116.

Disposed in support 114 is Venturi 120. Fuel is flowed to Venturi 120 through metering orifice 122 of about 0.05 millimeter diameter in sapphire member 124 that is mounted on orifice holder tube 126. Tube 126 is mounted on housing assembly 130 that is disposed in regulator valve structure 132 that includes downstream chamber 134 that is open to atmosphere. Diaphragm 140 is a stainless steel disk that is about 0.1 millimeter thick and has a diameter of about two centimeters and is seated between cap portion 142 and body portion 144 of assembly 132 with its peripheral edge secured between cap member 142 and a sealing O-ring. Carried by diaphragm 140 is a valve assembly sleeve that receives a threaded shank of outlet tube 126. Regulator valve assembly 150 has head portion 152 and a stem portion that is threadedly engaged with the sleeve. Received in base portion 144 is O-ring 156 against which valve head 152 is adapted to seat when the regulator valve 132 is closed to block fuel. The stem has axially extending groove in its externally threaded portion that provides a flow passage past diaphragm 140.

Upstream regulating valve chamber 157 has an inlet through passage 158. Also mounted in the housing is control valve 160 with inlet passage 162, an outlet to passage 158 and actuator 166. Canister coupling member 180 has valve opening stub 182 that defines passage 184 in which porous flow restriction 186 is disposed, seal member 178 and guide sleeve 190.

Carried on the handle portion 12 is piezoelectric unit 170 that is connected to electrodes 116 that provide a spark gap at the top of mantle 110 and an actuator 172 that is coupled to slide switch 174 which has a spring detent and is movable between "off" position and "on" position. Coupled to operating slide 174 is arm 176 and when slide 174 is moved forwardly, slide arm 176 opens control valve 160 to allow flow of vaporized fuel from inlet 162 through valve 160, outlet 158 and regulator valve 132 to mantle 110 and concurrently actuates the piezoelectric ignitor 170 to produce sparks at electrodes 116 to ignite the flow of fuel in mantle 110.

In operation, a canister 20 of liquified propane fuel (at a pressure of about 100 psi at room temperature) is secured in chamber 18 such that valve 30 is opened by stub 182. The liquified propane fuel is vaporized in downstream check valve chamber 68 and stub 182. When the fuel is in vaporized form in downstream check valve chamber 68, the check valve 58 is open in response to a pressure differential in the range of 5–12 psi across diaphragm 56. Should liquified fuel begin to flow through check valve passage 60 into chamber 68, the pressure in chamber 68 will immediately reduce the pressure differential across diaphragm 56 and cause check valve 58 to close instantly. Valve 58 will remain closed until the fuel in chamber 68 is fully vaporized and the pressure in downstream chamber 68 is sufficiently reduced so that the bias force of diaphragm 56 is overcome.

Regulator valve 132 is normally biased to an open position by diaphragm 140. The pressure in passage 158 (which establishes the pressure which will move valve 132 and thus control the flow rate through orifice 122) shifts the valve subassembly 132 when the diaphragm 140 is in neutral (valve open) position, and provides flow (at a rate of about ten cubic centimeters per minute) through orifice 122.

Fuel vapor flows from the regulating valve 132 into the central passage of orifice holder 126 for flow through metering orifice 122. That fuel flow entrains air for flow through Venturi 120 and the fuel/air mixture flows through alumina tube 112 to gas mantle 110 for ignition. Should the fuel pressure increase sufficiently to flex diaphragm 140, valve 132 will close and remain closed until the continuing fuel flow reduces that pressure such that the valve 132 will reopen and allow fuel flow through orifice 122 to resume.

Figure 4:
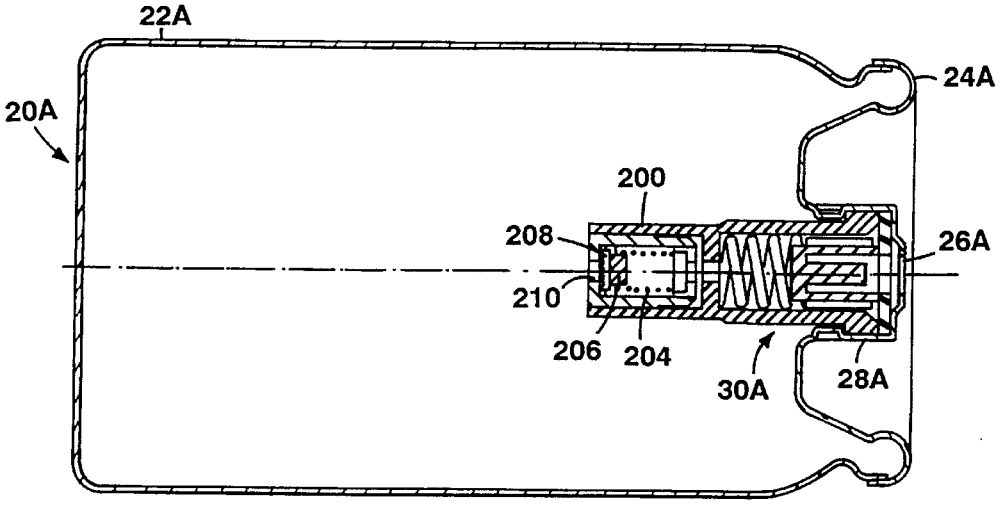
FIGS. 4 and 5 are sectional views, similar to FIG. 3 showing other fuel canister embodiments in accordance with the invention.
Figure 5:
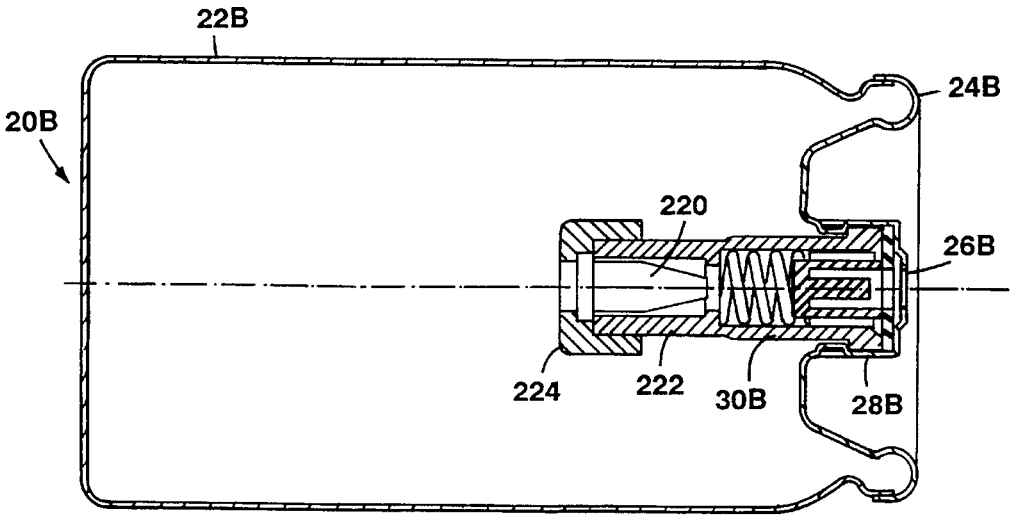

Other forms of fuel canisters are shown in FIGS. 4 and 5. In the embodiment shown in FIG. 4, the check valve includes housing 200 with spring 204, and valve member 206 which seats against housing end surface 208 to close port 210. In the embodiment shown in FIG. 5, a duck bill check valve assembly 220 is mounted in extension 222 and secured in position by cap 224.

Figure 6:
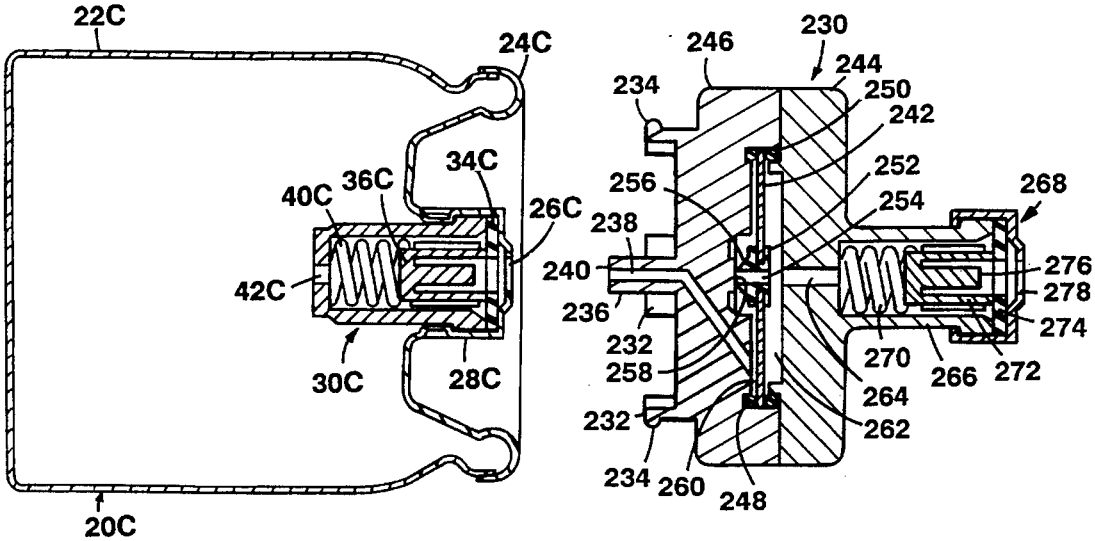
FIG. 6 is a sectional view of a releasable check valve assembly and cooperating fuel canister for use in an appliance of the type shown in FIG. 1.

Shown in FIG. 6 is a fuel canister-check valve assembly suitable for use in the flashlight appliance shown in FIGS. 1 and 2. Canister 20C includes tubular shell 22C of drawn aluminum that has a diameter of about three centimeters and a length of about four centimeters. Plated steel cap 24C is secured to shell body 22C and defines outlet port 26C and housing portion 28C in which is disposed outlet valve assembly 30C. That valve assembly includes inlet port 42C, and coil spring 40C biases valve member 36C against resilient valve seat 34C.

Check valve assembly 230 is adapted to be releasably secured to canister cap 24C by resilient skirt portions 232 that includes ridges 234. Coaxially disposed within skirt members 232 is stem 236 that defines flow passage 238 and whose end surface 240 engages the central post portion of valve member 36A when skirt 232 is snapped into cap 24C. In that position, the end surface 240 of stem 236 acts against the central post of valve member 36C to open that valve against the restoring force of spring 40C so that pressurized propane flows through inlet passage 238.

The check valve assembly includes stainless steel diaphragm 242 which is secured between metal housing members 244, 246 and sealed by O-rings 248, 250. Diaphragm 242 carries check valve member 252 that has through passage 254 surrounded by valve seat surface 256 that is seated on valve surface 258. Upstream check valve chamber 260 has a depth of about 0.1 millimeter and downstream check valve chamber 262 has a depth of about 0.2 millimeter. Inlet passage 238 terminates in upstream check valve chamber 260 and outlet passage 264 extends from downstream chamber 262. Disposed in tubular extension 266 is control valve assembly 268 that includes coil spring 270 that biases valve member 272 against resilient gasket 274. Valve member 272 has center post 276 that is aligned with outlet port 278 into which stub 182 is inserted when the assembly of canister 20C and check valve assembly 230 is inserted into and secured in chamber 18.

When canister 20A is so secured, liquified propane fuel is vaporized in downstream check valve chamber 262 and flows through passage 264 into and through outlet port 278. Should liquified fuel begin to flow through check valve passage 256, the pressure in chamber 262 will immediately reduce the pressure differential across diaphragm 242 and cause the check valve to close. That valve will remain closed until the fuel in chamber 262 is fully vaporized and the pressure in downstream chamber 262 is sufficiently reduced so that the bias force of diaphragm 242 is overcome and the check valve opens to allow flow of fuel through passage 254 and outlet port 278 to control valve 160.

While particular embodiments of the invention have been shown and described, various modifications will be apparent to those skilled in the art, and therefore, it is not intended that the invention be limited to the disclosed embodiments, or to details thereof, and departures may be made therefrom within the spirit and scope of the invention.

What is claimed is:

1. A gas powered appliance comprising housing structure with a fuel inlet port and recess structure for receiving fuel canister structure in communication with said inlet port, fuel supply conduit structure in said housing structure that has an outlet port, fuel control structure in said housing structure for controlling flow of fuel from said inlet port through said fuel supply conduit structure to said outlet port, fuel canister structure adapted for disposition in said recess structure, said fuel canister structure having a body portion, and outlet valve structure on said body portion for coupling to said inlet port when said fuel canister structure is disposed in said recess structure, and check valve structure for disposition in said recess structure in cooperation with said outlet valve structure for preventing liquid fuel from reaching said flow control structure when the fuel canister structure is disposed in the recess structure.

2. The appliance of claim 1 and further including mantle structure supported on said fuel supply conduit structure adjacent said outlet port and ignitor mechanism disposed in said housing structure for igniting fuel to cause said mantle structure to become incandescent and emit optical radiation.

3. The appliance of claim 1 wherein said check valve structure is in said fuel canister structure.

4. The appliance of claim 1 wherein said check valve structure is releasably attached to said fuel canister structure.

5. The appliance of claim 1 and further including porous flow restriction structure in said fuel supply conduit structure.

6. The appliance of claim 5 and further including valve opening stub structure in which said inlet port and said flow restriction structure are disposed, said stub structure being adapted to operate said outlet valve structure when said fuel canister structure is disposed in said recess structure.

7. The appliance of claim 1 wherein said check valve structure is of the diaphragm type.

8. The appliance of claim 1 wherein said appliance is a portable light source and has a handle portion sized to be grasped in a handle, and said recess structure is in said handle portion.

9. The appliance of claim 8 wherein said handle portion is of cylindrical configuration and has a diameter of less than ten centimeters and a length greater than said diameter.

10. The appliance of claim 8 and further including a head portion of larger dimension than said handle portion, and said head portion includes lens structure.

11. The appliance of claim 9 and further including mantle structure supported on said fuel supply conduit structure adjacent said outlet port and ignitor mechanism disposed in said housing structure for igniting fuel to cause said mantle structure to become incandescent and emit optical radiation.

12. The appliance of claim 11 wherein said mantle is composed of multifilament metal oxide strands.

13. The appliance of claim 12 wherein said check valve structure is selected from the group consisting of diaphragm valves, duck bill valves and coil spring biased valves.

14. The appliance of claim 13 and further including porous flow restriction structure in said fuel supply conduit structure.

15. The appliance of claim 14 and further including valve opening stub structure in which said inlet port and said flow restriction structure are disposed, said stub structure being adapted to operate said outlet valve structure when said fuel canister structure is disposed in said recess structure.

16. The appliance of claim 15 wherein said fuel canister structure contains a liquid hydrocarbon fuel such as isobutane, propane, gasoline, or the like.

17. The appliance of claim 16 wherein said appliance is a portable light source and has a handle portion sized to be grasped in a handle, and said recess structure is in said handle portion.

18. The appliance of claim 17 wherein said handle portion is of cylindrical configuration and has a diameter of less than ten centimeters and a length greater than said diameter, and further including a head portion of larger dimension than said handle portion, and said head portion includes lens structure adjacent said mantle structure.

19. The appliance of claim 18 wherein said check valve structure is in said fuel canister structure.

20. The appliance of claim 18 wherein said check valve structure is releasably attached to said fuel canister structure.

21. A fuel canister for use with a portable gas appliance, said appliance including housing structure with a fuel inlet port and recess structure for receiving said fuel canister structure, fuel supply conduit structure in said housing structure that has an outlet port, fuel control structure in said housing structure for controlling flow of fuel from said inlet port through said fuel supply conduit structure to said outlet port, said fuel canister being adapted for disposition in said recess structure and including outlet passage structure for coupling to said inlet port structure of said gas appliance, outlet valve structure disposed in said outlet passage and having a normally closed position preventing flow of fuel from said fuel canister and an open position, and check valve structure in the body of said fuel canister and coupled to said outlet valve structure, said check valve structure having upstream chamber structure, downstream chamber structure and valve structure between said upstream and downstream chamber structures and being adapted to close when the pressure differential between said upstream check valve chamber structure and said downstream check valve chamber structure is less than an predetermined value so that fuel does not flow from said upstream check valve chamber to said downstream check valve chamber.

22. The fuel canister of claim 21 wherein said check valve pressure differential that causes said check valve structure to close is in the range of five to twelve pounds per square inch.

23. The fuel canister of claim 22 wherein said fuel canister structure contains a liquid hydrocarbon fuel such as isobutane, propane, gasoline, or the like.

24. The fuel canister of claim 23 wherein said check valve structure is selected from the group consisting of diaphragm valves, duck bill valves and coil spring biased valves.

25. A detachable check valve assembly for releasable coupling to a fuel canister, said check valve assembly having outlet passage structure for coupling to inlet port structure of a gas appliance, inlet passage structure for coupling to the outlet port of a fuel canister, control valve structure disposed in said outlet passage and having a normally closed position preventing flow of fuel to said gas appliance and an open position, detachable coupling structure, and check valve structure in said detachable assembly, said check valve structure being disposed between said inlet passage structure and said control valve structure for preventing liquid fuel from reaching said control valve structure when said fuel canister structure is coupled to said gas appliance.

26. The check valve assembly of claim 25 wherein said check valve structure is selected from the group consisting of diaphragm valves, duck bill valves and coil spring biased valves.

27. The assembly of claim 26 wherein said detachable coupling structure is of the resilient snap type.

28. The assembly of claim 27 wherein said control valve structure includes seat structure adjacent said outlet passage, a valve member, and resilient structure for urging said valve member against said seat structure for closing said outlet passage.

* * * * *